US005553347A

United States Patent [19]

Inoue et al.

[11] Patent Number: 5,553,347

[45] Date of Patent: Sep. 10, 1996

[54] UPRIGHT VACUUM CLEANER

[75] Inventors: Takayuki Inoue, Kawanishi; Masami Fukumoto, Ikeda; Izumi Yamaura, Kawanishi, all of Japan

[73] Assignee: Matsushita Electric Industrial Co., Ltd., Osaka-fu, Japan

[21] Appl. No.: 423,198

[22] Filed: Apr. 18, 1995

[30] Foreign Application Priority Data

Apr. 19, 1994 [JP] Japan ..... 6-080530

[51] Int. Cl.[6] ..... A47L 9/00

[52] U.S. Cl. ..... 15/327.3; 15/346; 15/383; 180/116; 180/129

[58] Field of Search ..... 15/327.3, 346, 15/385; 180/116, 129

[56] References Cited

U.S. PATENT DOCUMENTS

| | | | |
|---|---|---|---|
| 4,571,849 | 2/1986 | Gardner et al. | 15/327.3 X |
| 4,884,315 | 12/1989 | Ehnert | 15/346 |
| 5,210,996 | 5/1993 | Fassauer | 15/327.3 X |
| 5,392,492 | 2/1995 | Fassauer | 15/327.3 |

*Primary Examiner*—Chris K. Moore
*Attorney, Agent, or Firm*—Panitch Schwarze Jacobs & Nadel, P.C.

[57] ABSTRACT

An upright vacuum cleaner has a floating function for lifting the upright vacuum cleaner in a cleaning operation by spouting discharge air flow to a floor to be cleaned, and at least a suction-air inlet port for sucking air with dusts is arranged at an outer portion of a bottom face of a floor nozzle unit of the upright vacuum cleaner.

9 Claims, 12 Drawing Sheets

UPRIGHT VACUUM CLEANER

FIELD OF THE INVENTION AND RELATED ART STATEMENT

1. Field of the Invention

The present-invention relates generally to an upright vacuum cleaner, which is suitable for the general user.

2. Description of the Related Art

FIG. 12 is a perspective view showing a conventional upright vacuum cleaner. As shown in FIG. 12, the conventional upright vacuum cleaner comprises a vacuum cleaner main body 3 and a floor nozzle 2, which is arranged under the vacuum cleaner main body 3. A dust collection bag 4 in the vacuum cleaner main body 3 is connected to an inlet port disposed at the bottom face of the floor nozzle 2 through a hose 1. The vacuum cleaner main body 3 has a motor/fan assembly 8 (generally referred to hereafter as "motor fan") for generating a suction force. Dust on a floor is drawn by the suction force generated by the motor fan 8 to the dust-collection bag 4 through the inlet port and the hose 1.

Because the vacuum cleaner main body 3 of the conventional upright vacuum cleaner carries the heavy motor fan 8 and the large dust collection bag 4, the conventional upright vacuum cleaner generally has a heavy weight and a large size. Therefore, there is problem that the conventional upright vacuum cleaner can not be easily handled or operated in use.

Accordingly, we have provided an upright vacuum cleaner which can be easily moved on a floor to be cleaned by using discharge air flow from a floor nozzle unit. The above-mentioned upright vacuum cleaner is now pending as the U.S. patent application Ser. No. 08/388,734 by the same inventors as the present invention.

FIG. 11 shows a sectional side view showing the upright vacuum cleaner taught in the U.S. patent application Ser. No. 08/388,734. In FIG. 11, the upright vacuum cleaner comprises a main body 9 and a floor nozzle unit 10. The main body 9 has a motor fan chamber 11 in which a motor fan 12 for generating a suction force is located, and a dust collection chamber 13 having a dust collection bag 14. A handle grip 15 for operating or handling the upright vacuum cleaner is provided on the uppermost position of the main body 9. The floor nozzle unit 10, which is disposed under the main body 9, has an inlet port 16B for drawing dust from on the floor. The inlet port 16B is arranged at a forward position (front side as shown by an arrow Z in FIG. 11) of the floor nozzle unit 10. The floor nozzle unit 10 has a float plate 15 having a flat face 15A, which is arranged to be parallel with the floor to be cleaned. A discharge air outlet port 16A for delivering the discharge air flow from the motor fan 12 is arranged at a center portion of the float plate 15. The discharge air flow from the discharge air outlet port 16A spreads outwardly along the flat face 15A of the float plate 15 around the discharge air outlet port 16A. Therefore, the upright vacuum cleaner is elevated from the floor to be cleaned during cleaning. As a result, the upright vacuum cleaner can be easily moved by hand on the floor.

However, the above-mentioned upright vacuum cleaner had difficulty in dust collecting. During cleaning operations, when the discharge air flow exhausted from the discharge air outlet port 16A spread along the flat face 15A of the float plate 15, the air flow in the backward direction scattered the dust on the floor to be cleaned because the inlet port 16B is only disposed at the forward position (front side) of the floor nozzle unit.

OBJECT AND SUMMARY OF THE INVENTION

The object of the present invention is to provide an upright vacuum cleaner which has remarkably improved cleaning capabilities for collecting dust on a floor to be cleaned, and improved handling for moving the upright vacuum cleaner.

In order to achieve the above-mentioned objects, an upright vacuum cleaner in accordance with the present invention comprises:

- a main body having a motor fan for generating a suction force, and a dust collection chamber for collecting dust,
- a floor nozzle unit, which is disposed under the main body, and provided for attracting dust on a floor to be cleaned into the dust collection chamber by the suction force generated by the motor fan,
- a grip handle for moving the upright vacuum cleaner, and
- a floor opposing face located on the floor nozzle unit, having an outlet port positioned to direct a discharge air flow to the floor from the motor fan to elevate said upright vacuum cleaner from the floor, and an inlet port arranged to encircle said outlet port of the floor opposing face to draw air with dust to the dust collection chamber through a suction air path.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

[First Embodiment]

Figure 1:
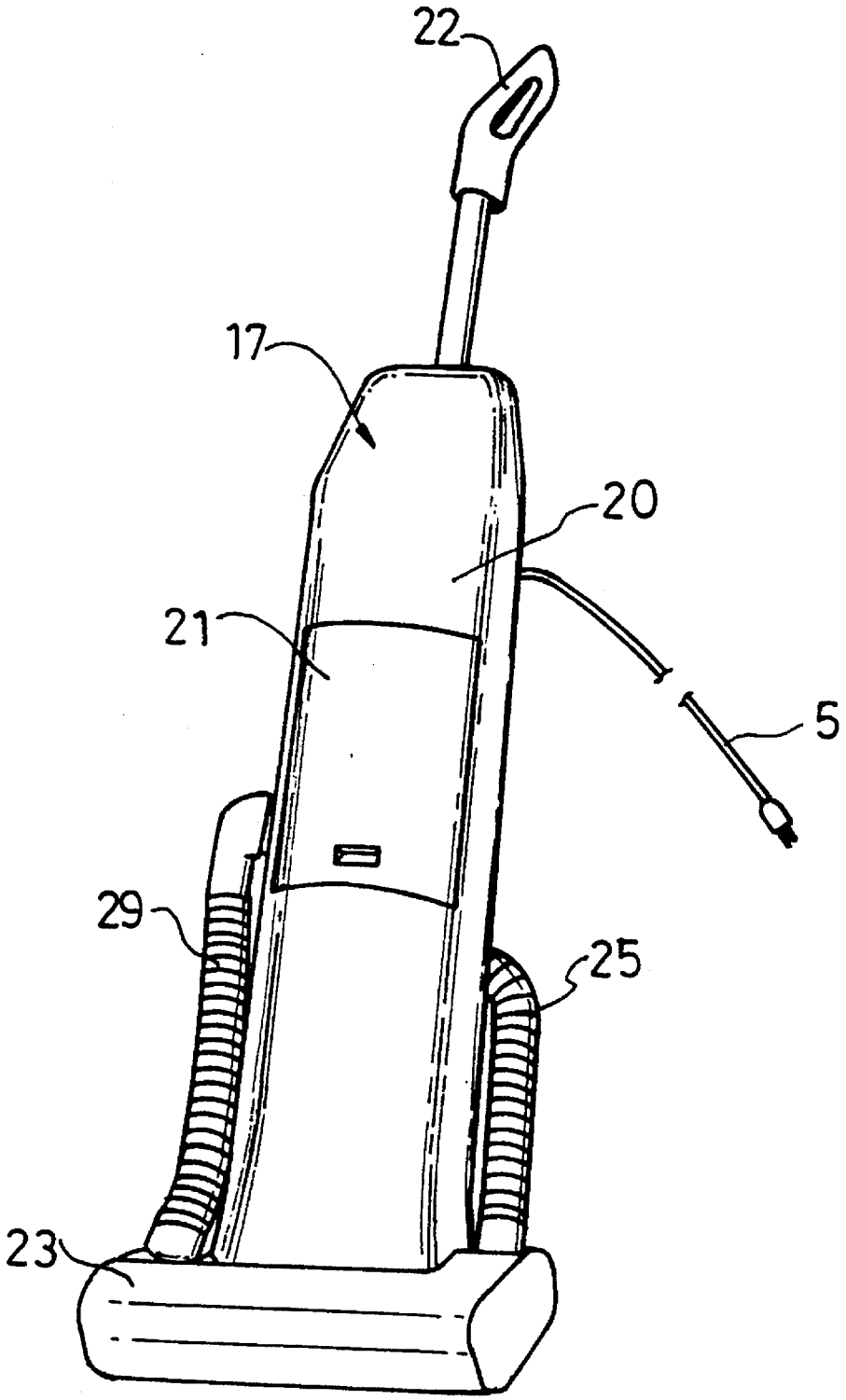
FIG. 1 is a perspective view of a first embodiment of an upright vacuum cleaner in accordance with the present invention.
Figure 2:
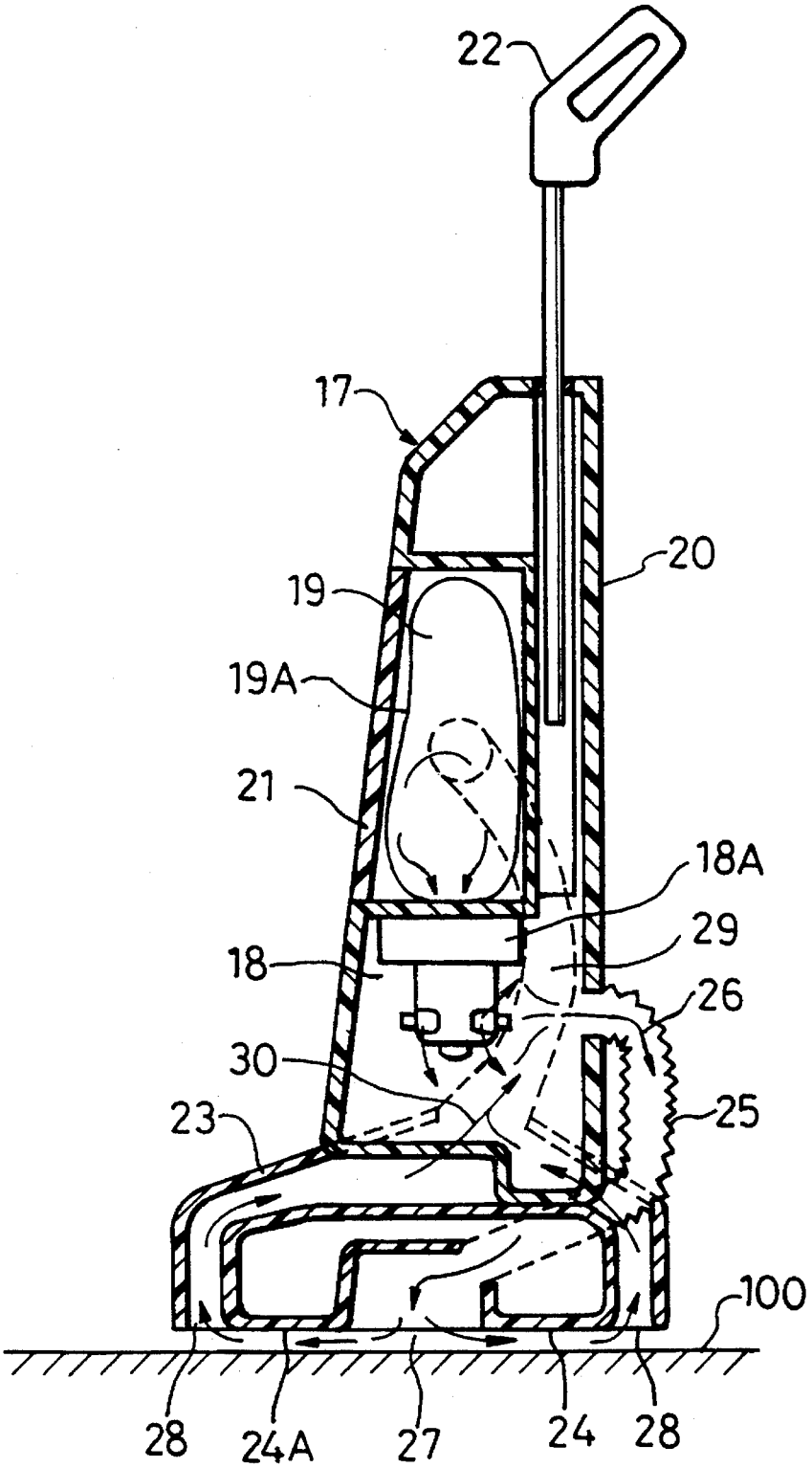
FIG. 2 is a sectional side view of the first embodiment of the upright vacuum cleaner of FIG. 2.
Figure 3:
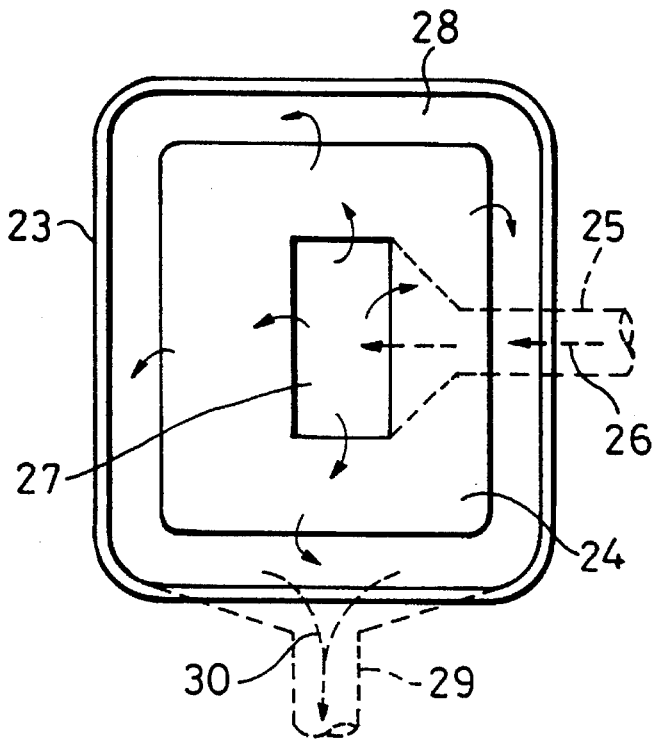
FIG. 3 is a bottom view showing a floor nozzle unit of the first embodiment of the upright vacuum cleaner of FIG. 1.

Hereafter, an upright vacuum cleaner of a first embodiment in accordance with the present invention will be described with reference to FIGS. 1 to 3. FIG. 1 shows a perspective view of the first embodiment of the upright vacuum cleaner in accordance with the present invention. FIG. 2 shows a sectional side view of the upright vacuum cleaner of FIG. 1. FIG. 3 shows a bottom view of a floor nozzle unit of the upright vacuum cleaner of FIG. 1.

The upright vacuum cleaner comprises a main body 17 and a floor nozzle unit 23. The main body 17 has a motor fan chamber 18 in which a motor fan 18A for generating a suction force is located, and a dust collection chamber 19 having a dust collection bag 19A for collecting dust drawn in by the suction force of the motor fan 18. The main body 17 is covered by a main case 20 and a detachable lid 21 for loading or unloading the dust collection bag 19A to the dust-collection chamber 19. A grip handle 22 for operating or handling the upright vacuum cleaner is provided on the uppermost position of the main body 17.

The main body 17 also has a cord 5 for connecting the electric power supply to the motor fan 18A etc., and a cord adjusting reel (not shown) for winding the cord 5.

As shown in FIG. 2, the floor nozzle unit 23 for drawing or sucking in dust on a floor 100 to be cleaned is provided under the main body 17. The floor nozzle unit 23 has a float plate 24, which is provided on a lower face of the floor nozzle unit 23, and has a floor-opposing flat face which is parallel with the floor 100. The float plate 24 has a discharge air outlet port 27 for exhausting or spouting the discharge air flow 26 of the motor fan 18A through a discharge air path 25, and a suction air inlet port 28, which is arranged to surround the discharge air outlet port 27. The suction air inlet port 28 is connected to the dust collection bag 19A in the dust collection chamber 19 through the suction air path 29. The float plate 24 is arranged to receive an elevation force generated by the discharge air flow 26 which is guided between the float plate 24 and the floor 100.

Operation of the above-mentioned first embodiment is elucidated hereafter.

When the motor fan 18 rotates, the suction air flow 30 and the discharge air flow 26 are generated in the suction air inlet port 28 and the discharge air outlet port 27 through the dust collection chamber 19 and the motor fan chamber 18 as shown with arrows in FIG. 2. The generated discharge air flow 26 is guided to flow between the float plate 24 and the floor 100 to be cleaned, and thereby the float plate 24 is elevated from the floor 100. The discharge air flow 26 is drawn in by the suction air inlet port 28, which is arranged on the outer portion of the float plate 24 to surround the discharge air outlet port 27 as shown in FIG. 3, and directed to the dust collection bag 19A through the suction air path 29.

According to the above-mentioned first embodiment of the upright vacuum cleaner, almost all the discharge air flow 26 from the discharge air outlet port 27 is drawn in by the suction air inlet port 28 around the discharge air outlet port 27. In other words, dust is not scattered on the floor 100 by the discharge air flow from the discharge air outlet port 27.

In the cleaning operation, since the elevation force is applied to the float plate 24, the frictional resistance between the floor nozzle unit 23 and the floor 100 is reduced to be extremely small or almost zero. According to the first embodiment of the present invention, the upright vacuum cleaner can be easily and lightly moved in all directions on the floor 100 by hand.

Apart from the first embodiment wherein the floor nozzle unit 23 has the bottom face of a substantially rectangular shape, a modified embodiment may be provided with a floor nozzle unit having a bottom face of a circular shape or an oval shape.

Apart from the above-mentioned first embodiment wherein the inlet port 28 arranged to encircle the discharge air outlet port 27 is provided in the floor nozzle unit 23 of the upright vacuum cleaner, a modified embodiment may be provided such that an inlet port arranged to encircle a discharge air outlet port is provided in a floor nozzle unit of the general vacuum cleaner.

[Second embodiment]

Figure 4:
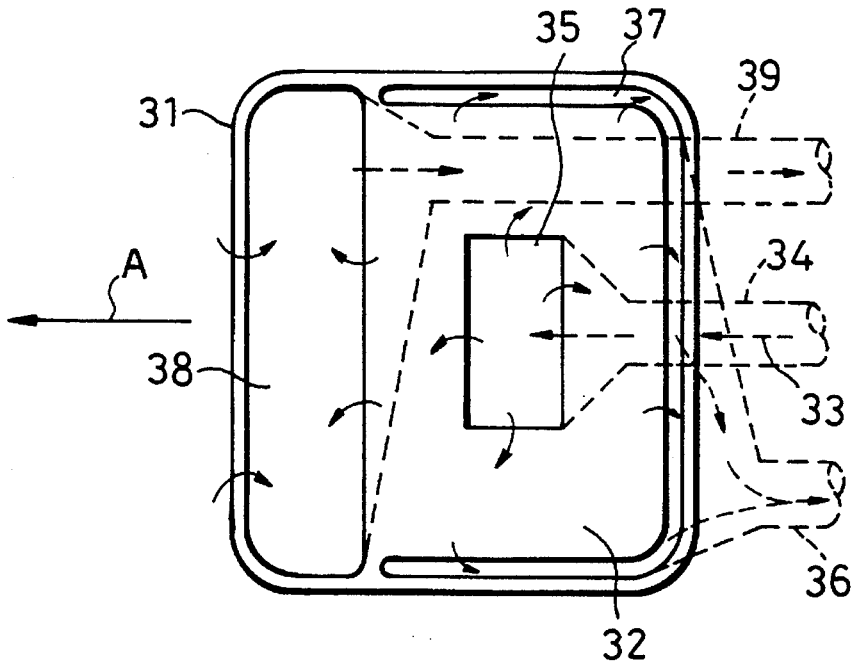
FIG. 4 is a bottom view showing a floor nozzle unit of a second embodiment of the upright vacuum cleaner in accordance with the present invention.

Hereafter, an upright vacuum cleaner of a second embodiment in accordance with the present invention is described with reference to FIG. 4. FIG. 4 is a bottom view showing a floor nozzle unit 32 of the upright vacuum cleaner of the second embodiment. Corresponding parts and components to the first embodiment are shown with the same reference numerals and marks, and the description thereof made in the first embodiment similarly apply. Differences and features of this second embodiment from the first embodiment are as follows.

In the second embodiment, the floor nozzle unit 31 has a float plate 32 having a flat face which is arranged parallel with the floor to be cleaned. A discharge air outlet port 35 for directing the discharge air flow 33 is arranged at a center portion of the float plate 32. The discharge air outlet port 35 is connected to the motor fan through a discharge air path 36. A first suction air inlet port 38 for drawing in air with dust from the floor is arranged at a forward portion (front side) of the flat face of the float plate 32, and has a large and wide opening as shown in FIG. 4. In FIG. 4, a forward direction is shown by an arrow A. The floor nozzle unit 31 is moved in the forward direction on the floor 100 so as to drawn in the dust on the floor.

The first suction air inlet port 38 is connected to a first suction air path 39 for directing the suction air flow through ducts to the dust collection bag. A second suction air inlet port 37, which is connected to the dust collection bag through a second suction air path 36, is arranged at a right side portion, a left side portion and a back side portion of the outer region in the bottom face of the float plate 32. Thus, the second suction air inlet port 37 has a U-shaped narrow opening on the bottom face as shown in FIG. 4. The first suction air path 39 and the second suction air path 36 are formed into a single path or are connected to a path which is connected to the dust collection bag.

Operation of the above-mentioned second embodiment is elucidated hereafter.

When the motor fan rotates, the suction air flow is generated in the first suction air inlet port 38 and the second suction air inlet port 37, and the discharge air flow is generated in the discharge air outlet port 35. The generated discharge air flow 33 is guided to flow between the float plate 32 and the floor, and thereby the upright vacuum cleaner is elevated from the floor. The discharge air flow 33 is drawn in by the first suction air inlet port 38 and the second suction air inlet port 37.

As a result, dust is not scattered on the floor by the discharge air flow 33. Since the first suction air inlet port 38 having a large opening is arranged in the forward portion of the float plate 32 of the floor nozzle unit 31, the upright vacuum cleaner of the second embodiment can draw a large amount of dust through the first suction air inlet port 38.

[Third embodiment]

Figure 5:
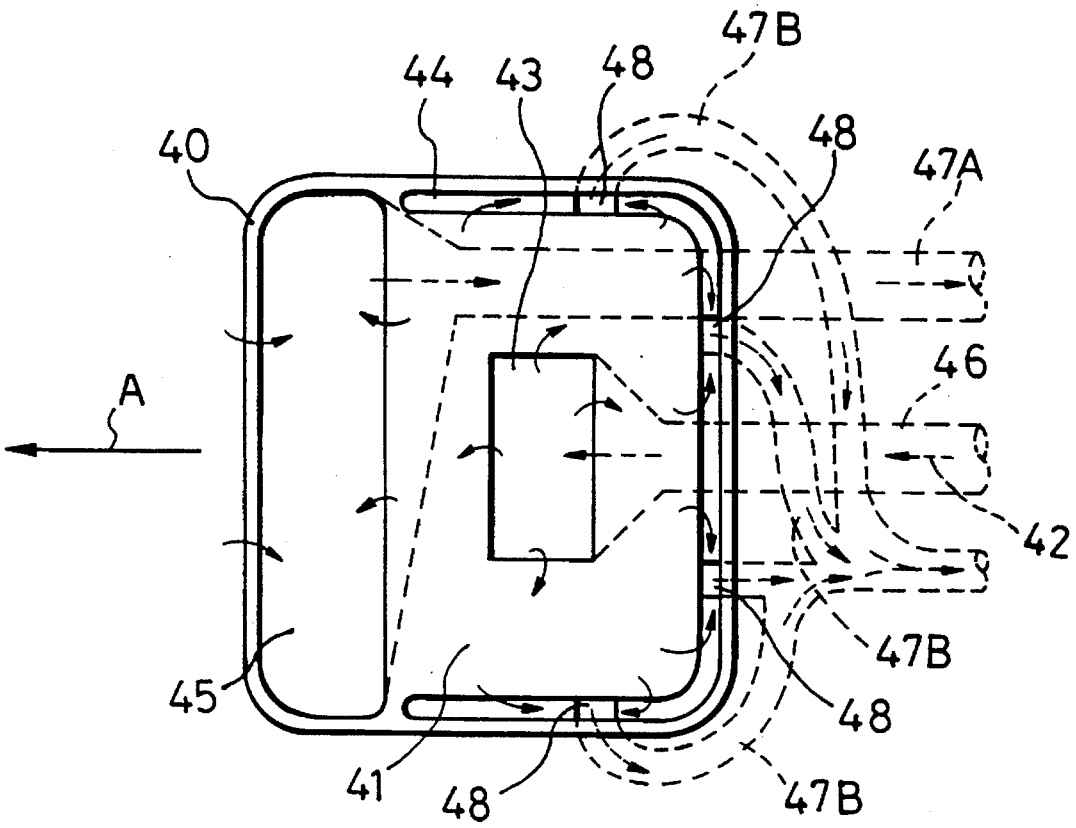
FIG. 5 is a bottom view showing a floor nozzle unit of a third embodiment of the upright vacuum cleaner in accordance with the present invention.

Hereafter, an upright vacuum cleaner of a third embodiment in accordance with the present invention is described with reference to FIG. 5. FIG. 5 is a bottom view showing a floor nozzle unit 40 of the upright vacuum cleaner of the third embodiment. Corresponding parts and components to the first embodiment are shown with the same reference numerals and marks, and the descriptions thereof made in the first embodiment similarly apply. Differences and features of this third embodiment from the first embodiment are as follows.

In the third embodiment, the floor nozzle unit 40 has a float plate 41 having a flat face which is arranged parallel with a floor to be cleaned. A discharge air outlet port 43 for directing the discharge air flow is formed at a center portion of the float plate 41. A first suction air inlet port 45 for drawing in air with dust from the floor is formed at a forward portion (front side) of the flat face of the float plate 41, and has a large and wide opening.

A second suction air inlet port 44 is arranged at a right side portion, a left side portion and a back side portion of the outer region in the bottom face of the float plate 41. Thus, the second suction air inlet port 44 has a U-shaped narrow opening on the bottom face as shown in FIG. 5.

The discharge air outlet port 43 is connected to the motor fan through a discharge air path 46. The first suction air inlet port 45 is connected to a dust collection bag through a first suction air path 47A, and the second suction air inlet port 44 is connected to the dust collection bag through a plurality of second suction air paths 47B.

In the third embodiment, the second suction air inlet port 44 is formed as a groove having a concave shape. Plural entrances 48 for the second suction air paths 47B are arranged at innermost portions of the second suction air inlet port 44 to lead the air being drawn in to the second suction air paths 47B. As shown in FIG. 5, the plural entrances 48 are formed to connect into a single path connected to the dust collection bag.

Apart from the third embodiment wherein these plural entrances 48 are formed to connect into one path connected to the dust collection bag, a modified embodiment may be such that plural entrances in the second suction air inlet port are connected to a dust collection bag through plural second suction air paths, respectively. Another modified embodiment may be such that one second suction air path connects between plural entrances and a dust collection bag.

Operation of the above-mentioned third embodiment is elucidated hereafter.

When the motor fan rotates, the suction air flow is generated in the first suction air inlet port 45 and the second suction air inlet port 44, and the discharge air flow 42 is generated in the discharge air outlet port 43. The generated discharge air flow 42 is guided to flow between the float plate 41 and the floor to be cleaned, and thereby the upright vacuum cleaner is elevated from the floor. The discharge air flow 42 is drawn in by the first suction air inlet port 45 and the second suction air inlet port 44. Since plural entrances 48 for the second suction air path 47B are arranged at substantially the same intervals in the second suction air inlet port 44, the suction force of the suction air flow is uniformly generated in all positions of the second suction air inlet port 44, and the dust on the floor is drawn in by substantially the same suction force at all positions in the second suction air inlet port 44.

As a result, the upright vacuum cleaner of the third embodiment can be designed to produce a large suction force in the first suction air inlet port 45 because the necessary suction force for the second suction air inlet port 44 is reduced. The upright vacuum cleaner of the third embodiment can be operated to remove dust on the floor with a high degree of efficiency.

[Fourth embodiment]

Figure 6A:
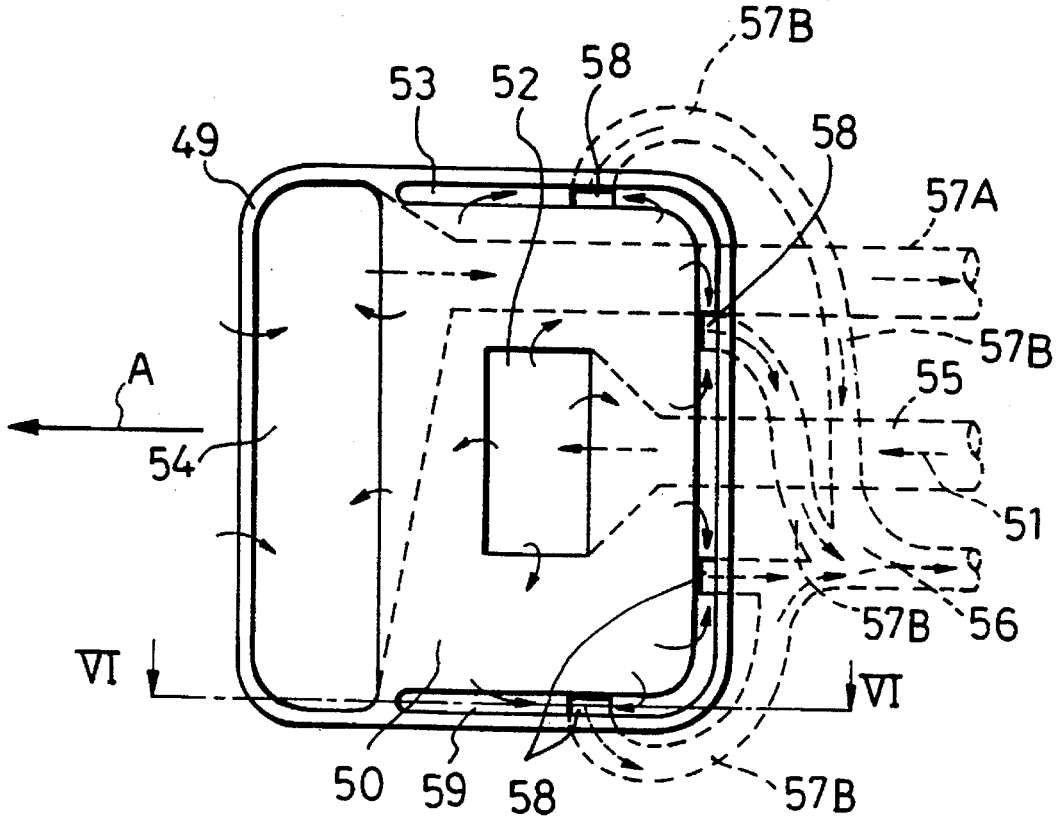
FIG. 6A is a bottom view showing a floor nozzle unit of a fourth embodiment in accordance with the present invention.
Figure 6B:
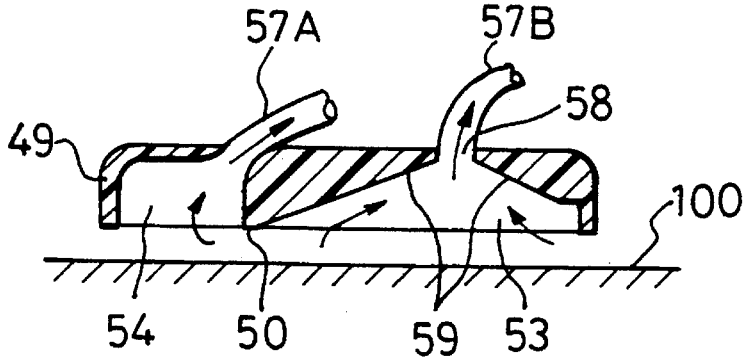
FIG. 6B is a sectional side view showing the floor nozzle unit of FIG. 6A.

Hereafter, an upright vacuum cleaner of a fourth embodiment in accordance with the present invention is described with reference to FIG. 6A and FIG. 6B. FIG. 6A is a bottom view showing a floor nozzle unit 49 of the upright vacuum cleaner of the fourth embodiment. FIG. 6B is a sectional side view showing the floor nozzle unit 49 of FIG. 6A. Corresponding parts and components to the first embodiment are shown by the same reference numerals and marks, and the descriptions thereof made in the first embodiment similarly apply. Differences and features of this fourth embodiment from the first embodiment are as follows.

In the fourth embodiment, the floor nozzle unit 49 has a float plate 50 having a flat face which is arranged to be parallel with the floor 100 to be cleaned. A discharge air outlet port 52 for directing the discharge air flow 51 is arranged at a center portion of the float plate 50. A first suction air inlet port 54 for drawing in air with dust from the floor 100 is arranged at a forward portion (front side) of the flat face of the float plate 50, and has a large and wide opening.

A second suction air inlet port 53 is arranged at a right side portion, a left side portion and a back side portion of the outer region in the bottom face of the float plate 50. Thus, the second suction air inlet port 53 has a U-shaped narrow opening on the bottom face as shown in FIG. 6A.

The discharge air outlet port 52 is connected to the motor fan through a discharge air path 55. The first suction air inlet port 54 is connected to the motor fan through a first suction air path 57A, and the second suction air inlet port 53 is connected to the motor fan through a plurality of second suction air paths 57B.

In the fourth embodiment, the second suction air inlet port 53 is formed as a groove with a concave shape, and has a slanted face 59 at an innermost face to smoothly guide the suction air flow 56 to entrances 58 for the second suction air paths 57B. The entrances 58 are arranged at innermost portions of the second suction air inlet port 53 to lead the drawn in air to the second suction-air paths 57B. As a result, dust is drawn in by substantially the same suction force at any position in the second suction air inlet port 53.

In other words, since the innermost face of the second suction air inlet port 53 is arranged to have the slanted face 59 against the floor 100 as shown in FIG. 6B, the suction force at the floor 100 adjacent to the entrance 58 for the second suction air path 57B is designed to have the same strength as the suction force at the floor 100 with distance from the entrance 58.

Operation of the above-mentioned fourth embodiment is elucidated hereafter.

When the motor fan rotates, the suction air flow 56 is generated in the first suction air inlet port 54 and the second suction air inlet port 53, and the discharge air flow 51 is generated in the discharge air outlet port 52. The generated discharge air flow 51 is guided to flow between the float plate 50 and the floor 100, and thereby the upright vacuum cleaner is elevated from the floor 100. The discharge air flow 51 is drawn in by the first suction air inlet port 54 and the second suction air inlet port 53.

Since the second suction air inlet port 53 has the slanted face 59 at the innermost portion of the second suction air inlet port 53, the second suction air inlet port 53 is formed to have a gradually smaller passage as the distance from the entrance 58 is increased. Therefore, the upright vacuum cleaner of the fourth embodiment can produce substantially the same suction force at all positions in the second suction air inlet port 53.

As a result, the upright vacuum cleaner of the fourth embodiment can be designed to reduce the volume of the suction air flow of the motor fan because the necessary suction force for the second suction air inlet port 53 is produced by the reduced suction air flow of the motor fan. The upright vacuum cleaner of the fourth embodiment can be operated to remove dust with a high degree of efficiency.

Figure 6C:
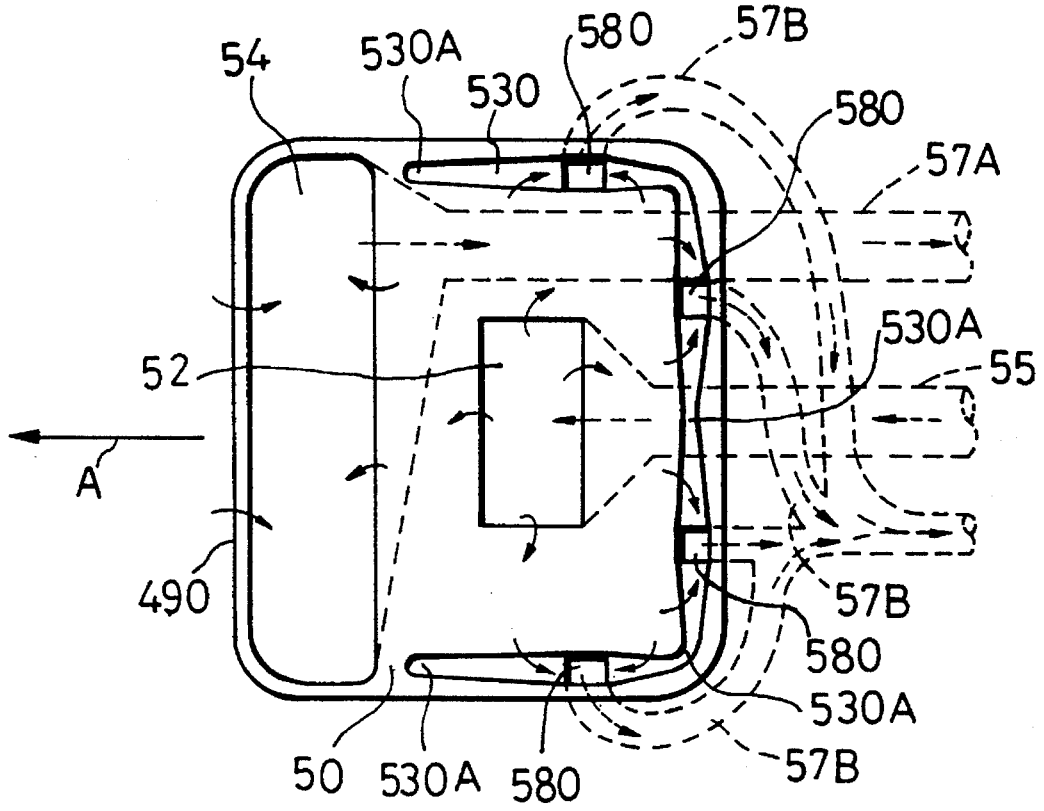
FIG. 6C is a bottom view showing a floor nozzle unit of another embodiment in accordance with the present invention.

Apart from the fourth embodiment wherein the second suction air inlet port 53 has the slanted face at the innermost face of the second suction air inlet port 53, a modified embodiment shown in FIG. 6C may be such that a second suction air inlet port 530 is formed to have narrow portions 530A at a part distant from the entrance 580 for the second suction air path. FIG. 6C is a bottom view showing a floor nozzle unit 490 of another embodiment. The floor nozzle unit 490 can produce substantially the same suction force at all positions in the second suction air inlet port 530.

[Fifth embodiment]

Figure 7A:
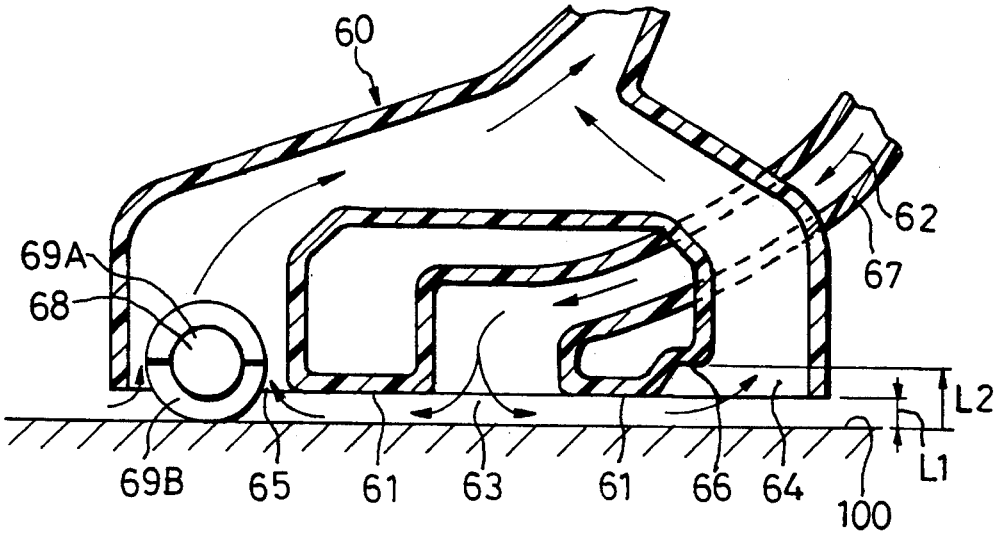
FIG. 7A is a sectional side view showing a floor nozzle unit of a fifth embodiment of the upright vacuum cleaner in accordance with the present invention.
Figure 7B:
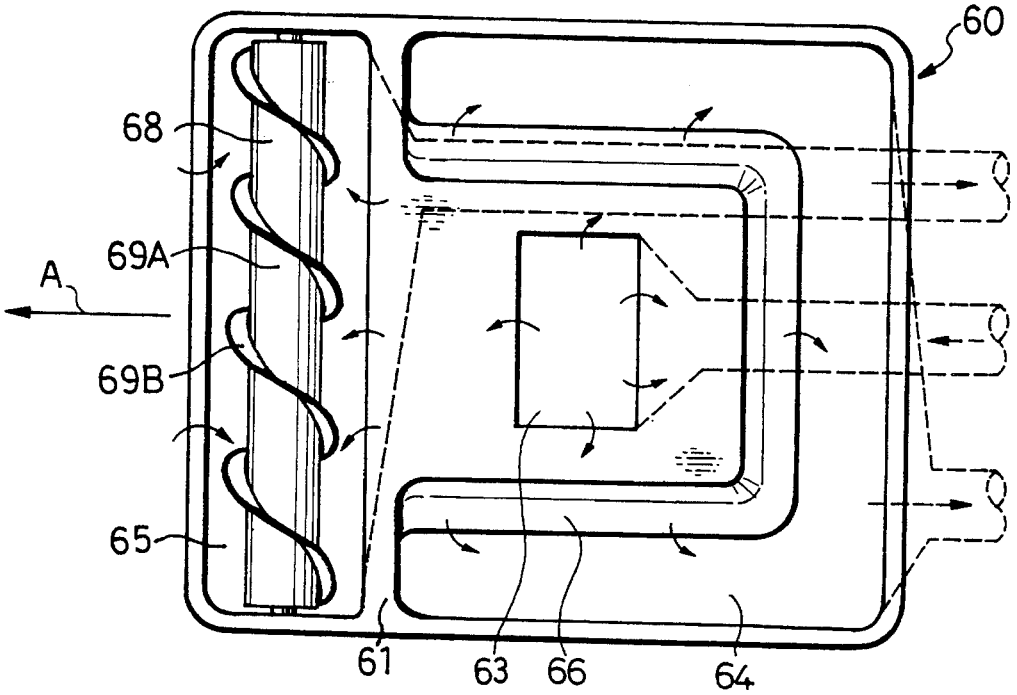
FIG. 7B is a bottom view showing the floor nozzle unit of FIG. 7A.

A fifth embodiment of the present invention is described with reference to FIG. 7A and FIG. 7B. FIG. 7A is a sectional side view showing a floor nozzle unit 60 of an upright vacuum cleaner in accordance with the present invention. FIG. 7B is a bottom view showing the floor nozzle unit 60 of FIG. 7A. Corresponding parts and components to the first embodiment are shown by the same reference numerals and marks, and the descriptions thereof made in the first embodiment similarly apply. Differences and features of this fifth embodiment from the first embodiment are as follows.

In the fifth embodiment, the floor nozzle unit 60 has a float plate 61 having a flat face, which is arranged parallel with the floor 100 to be cleaned. A discharge air outlet port 63 for directing the discharge air flow 62 from the motor fan is arranged at a center portion of the float plate 61.

A first suction air inlet port 65 for drawing in air with dust from the floor 100 is arranged at a forward portion (front side) of the flat face of the float plate 61, and has a large and wide opening. A second suction air inlet port 64 is arranged at a right side portion, a left side portion and a back side portion of the outer region of the bottom face of the float plate 61. Thus, the second suction air inlet port 64 has a U-shaped narrow opening on the bottom face as shown in FIG. 7B.

The discharge air outlet port 63 is connected to the motor fan through a discharge air path 67. The second suction air inlet port 64 has a stepped portion 66, which is formed along the inside edge of the second suction air inlet port 64 around the discharge air outlet port 63. In FIG. 7A, letters L1 show a distance between the floor 100 and the float plate 61. The letters L2 show a distance between the floor 100 and the stepped portion 66 facing the floor 100. These distances L1 and L2 have the following relation:

$$L1<L2.$$

A rotary brush 68 arranged in the first suction air inlet port 65 is rotated by a motor (not shown) during cleaning. The rotary brush 68 comprises a rotation drum 69A having a helical fin made of an elastic material, such as rubber, or a helical brush for sweeping or brushing the floor 100.

Operation of the above-mentioned fifth embodiment is elucidated hereafter.

When the motor fan rotates, the suction air flow is generated in the first suction air inlet port 65 and the second suction air inlet port 64. At the same time, the discharge air flow 62 is generated in the discharge air outlet port 63. The generated discharge air flow 62 is guided to flow between the float plate 61 and the floor 100, and thereby the upright vacuum cleaner is elevated from the floor 100. The discharge air flow 62 is drawn in by the first suction air inlet port 65 and the second suction air inlet port 64.

In the upright vacuum cleaner of the fifth embodiment, because the distance L2 of the stepped portion 66 is longer than the distance L1 of the float plate 61, the space under the stepped portion 66 provides a larger air flow passage than the space under the float plate 61. As a result, the velocity of air flow of the discharge air flow 62 is reduced under the stepped portion 66, and thereby the discharge air flow 62 can be smoothly and surely drawn into the second suction air inlet port 64.

The upright vacuum cleaner of the fifth embodiment can be designed to reduce the volume of the suction air flow generated by the motor fan because the necessary suction force for the second suction air inlet port 64 is reduced. The upright vacuum cleaner of the fifth embodiment can be operated to remove dust with a high degree of efficiency.

According to the above-mentioned fifth embodiment, since the discharge air flow 62 can be smoothly and powerfully drawn in by the second suction air inlet port 64, the second suction air inlet port 64 is designed to have a small width, thereby downsizing the floor nozzle unit of the upright vacuum cleaner.

Apart from the above-mentioned second embodiment wherein the second suction air inlet port 64 has the stepped portion 66 along the inside edge of the second suction air inlet port 64, a modified embodiment may be such that a second suction air inlet port has a sloped face along the inside edge of the second suction air inlet port, and the sloped face is formed to continuously connect between the float plate and the second suction air inlet port.

[Sixth embodiment]

Figure 8A:
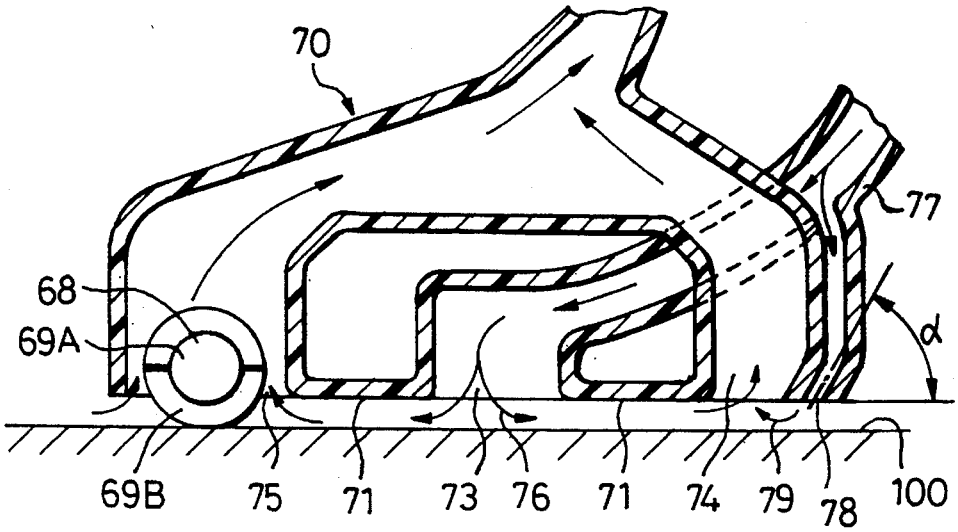
FIG. 8A is a sectional side view showing a floor nozzle unit of a sixth embodiment of the upright vacuum cleaner in accordance with the present invention.
Figure 8B:
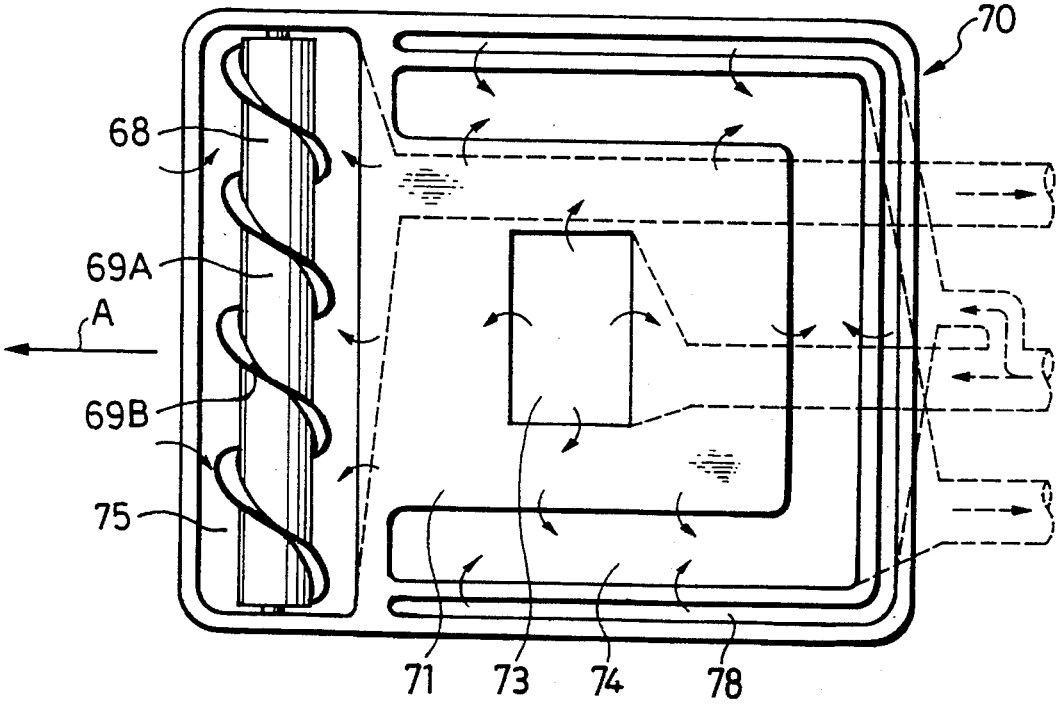
FIG. 8B is a bottom view showing the floor nozzle unit of FIG. 8A.

Hereafter, an upright vacuum cleaner of a sixth embodiment in accordance with the present invention is described with reference to FIGS. 8A and 8B. FIG. 8A is a sectional side view showing a floor nozzle unit 70 of the upright vacuum cleaner of the sixth embodiment. FIG. 8B is a bottom view showing the floor nozzle unit 70 of FIG. 8A. Corresponding parts and components to the first embodiment are shown by the same reference numerals and marks, and the descriptions thereof made in the first embodiment similarly apply. Differences and features of this sixth embodiment from the first embodiment are as follows.

In the sixth embodiment, the floor nozzle unit 70 has a float plate 71 having a flat face, which is arranged parallel with the floor 100 to be cleaned. A discharge air outlet port 73 for directing a first discharge air flow 76 of the motor fan is arranged at a center portion of the float plate 71.

A first suction air inlet port 75 for drawing in air with dust from the floor 100 is formed at a forward portion (front side) of the flat face of the float plate 71, and has a large and wide opening. A second suction air inlet port 74 is arranged at a right side portion, a left side portion and a back side portion of the outer region in the bottom face of the float plate 71. As shown In FIGS. 8A and 8B, a nozzle 78 for directing a second discharge air flow 79 to the floor 100 is arranged at an outer portion of the second suction air inlet port 74. The nozzle 78 and the discharge air outlet port 73 are arranged to direct the discharge air flow from the motor fan through a discharge air path 77 to the floor 100. The nozzle 78 is arranged to be inclined at an angle $\alpha$ with respect to the flat face of the float plate 71, so as to direct the second discharge air flow 79 in an inward direction as shown in FIG.8A. Therefore, the second discharge air flow 79 from the nozzle 78 flows toward the second suction air inlet port 74.

A rotary brush 68 arranged in the first suction air inlet port 75 is rotated by a motor (not shown) during cleaning. The rotary brush 68 comprises a rotation drum 69A having a helical fin made of an elastic material, such as rubber, or a helical brush for sweeping or brushing the floor 100.

Operation of the above-mentioned sixth embodiment is elucidated hereafter.

When the motor fan rotates, the suction air flow is generated in the first suction air inlet port 75 and the second suction air inlet port 74. At the same time, the first discharge air flow 76 is guided to flow between the float plate 71 and the floor 100, and thereby the upright vacuum cleaner is elevated from the floor 100. The first discharge air flow 76 is drawn in by the first suction air inlet port 75 and the second suction air inlet port 74. Since the velocity of the first discharge air flow 76 is weakened by meeting the second discharge air flow 79 under the second suction air inlet port 74, the weakened discharge air flow is smoothly and surely drawn in by the second suction air inlet port 74.

Therefore, the upright vacuum cleaner of the sixth embodiment can be designed to reduce the volume of the suction air flow of the motor fan because the necessary suction force for the second suction air inlet port 74 is reduced. The upright vacuum cleaner of the sixth embodiment can be operated to remove dust with a high degree of efficiency.

[Seventh embodiment]

Figure 9A:
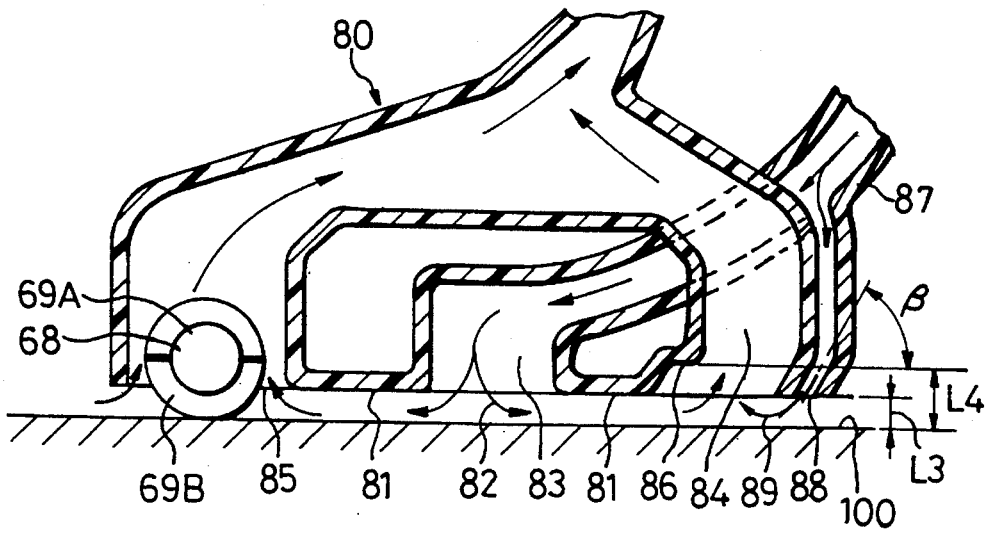
FIG. 9A is a sectional side view showing a floor nozzle unit of a seventh embodiment of the upright vacuum cleaner in accordance with the present invention.
Figure 9B:
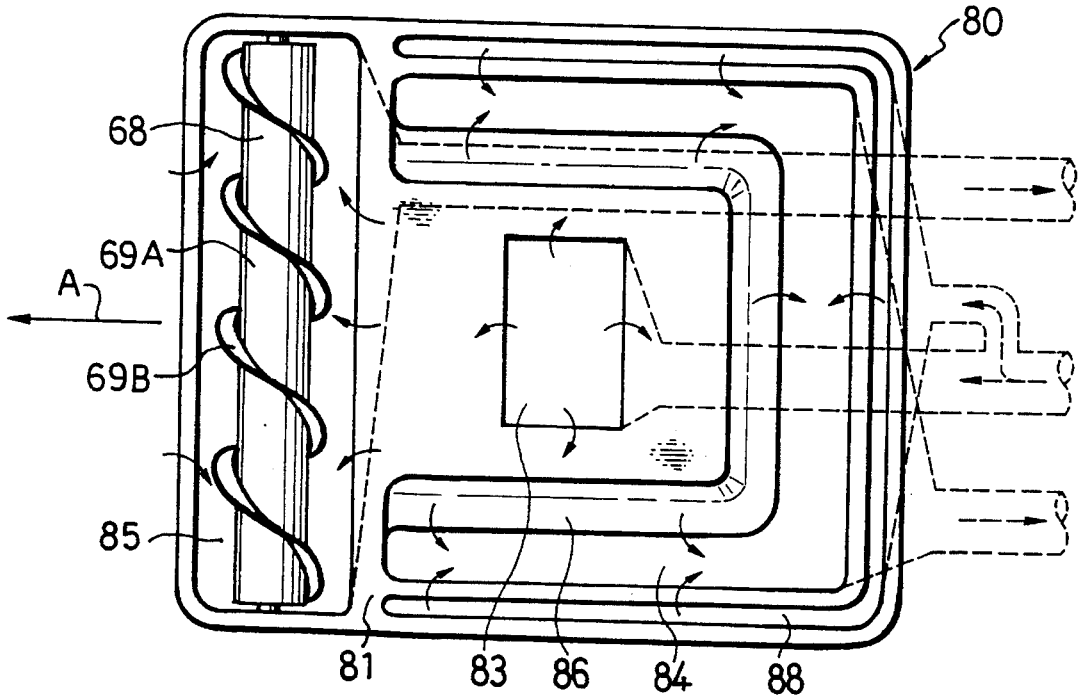
FIG. 9B is a bottom view showing the floor nozzle unit of FIG. 9A.

Hereafter, an upright vacuum cleaner of a seventh embodiment in accordance with the present invention is described with reference to FIGS. 9A and 9B. FIG. 9A is a sectional side view showing a floor nozzle unit 80 of the upright vacuum cleaner of the seventh embodiment. FIG. 9B is a bottom view showing the floor nozzle unit 80 of FIG. 9A. Corresponding parts and components to the first embodiment are shown by the same reference numerals and marks, and the descriptions thereof made in the first embodiment similarly apply. Differences and features of this seventh embodiment from the first embodiment are as follows.

In the seventh embodiment, the floor nozzle unit 80 has a float plate 81 having a flat face, which is arranged parallel with the floor 100 to be cleaned. A first discharge air outlet port 83 for directing a first discharge air flow 82 of the motor fan is arranged at a center portion of the float plate 81.

A first suction air inlet port 85 for drawing in air with dust from the floor 100 is formed at a forward portion (front side) of the flat face of the float plate 81, and has a large and wide opening. A second suction air inlet port 84, is arranged at a right side portion, a left side portion and a back side portion of the outer region in the bottom face of the floor nozzle unit 80. Thus, the second suction air inlet port 84 has a U-shaped narrow opening on the bottom face as shown in FIG. 9B. The second suction air inlet port 84 has a stepped portion 86, which is formed along the inside edge of the second suction air inlet port 84 around the discharge air outlet port 83 as shown in FIGS. 9A and 9B. In FIG. 9A, letters L3 show a distance between the floor 100 and the float plate 81, and letters L4 show a distance between the floor 100 and the stepped portion 86 facing the floor 100. These distances L3 and L4 have the following relation:

$$L3<L4.$$

A nozzle 88 for directing a second discharge air flow 89 to the floor 100 is arranged at an outer portion of the second suction air inlet port 84. The nozzle 88 and the discharge air outlet port 83 are arranged to direct the discharge air flow to the floor 100 from the motor fan through a discharge air path 87. The nozzle 88 is arranged to be inclined at an angle $\beta$ against the flat face of the float plate 81, so as to direct the second discharge air flow 89 in an inward direction as shown in FIG. 9A. Therefore, the second discharge air flow 89 from the nozzle 88 flows toward the second suction air inlet port 84.

A rotary brush 68 arranged in the first suction air inlet port 85 is rotated by a motor (not shown) during cleaning. The rotary brush 68 comprises a rotation drum 69A having a helical fin made of an elastic material, such as rubber, or a helical brush for sweeping or brushing the floor 100.

Operation of the above-mentioned seventh embodiment is elucidated hereafter.

When the motor fan rotates, the suction air flow is generated in the first suction air inlet port 85 and the second suction air inlet port 84. At the same time, the first discharge air flow 82 is generated in the discharge air outlet port 83, and the second discharge air flow 89 is generated in the nozzle 88. The first discharge air flow 82 is guided to flow between the float plate 81 and the floor 100, and thereby the upright vacuum cleaner is elevated from the floor 100. The first discharge air flow 82 is drawn in by the first suction air inlet port 85 and the second suction air inlet port 84.

Since the distance L4 of the stepped portion 86 is longer than the distance L3 of the float plate 81, the velocity of the first discharge air flow 82 is reduced in the space under the stepped portion 86. Because the velocity of the first discharge air flow 82 is weakened by meeting the second discharge air flow 89 under the second suction air inlet port 84, the weakened discharge air flow is smoothly and surely drawn in by the second suction air inlet port 84.

In the upright vacuum cleaner of the seventh embodiment, since the velocity of the first discharge air flow 82 is reduced in a space under the stepped portion 86, the discharge air flow 82 directed from the nozzle can be set to have low pressure. As a result, a large amount of discharge air flow 82 can be distributed to the discharge air outlet port 83.

The upright vacuum cleaner of the seventh embodiment can be designed to reduce the volume of the suction air flow of the motor fan because the necessary suction force for the second suction air inlet port 84 is reduced without reducing the elevation force. The upright vacuum cleaner of the seventh embodiment can be operated to remove dust with a high degree of efficiency.

[Eighth embodiment]

Figure 10A:
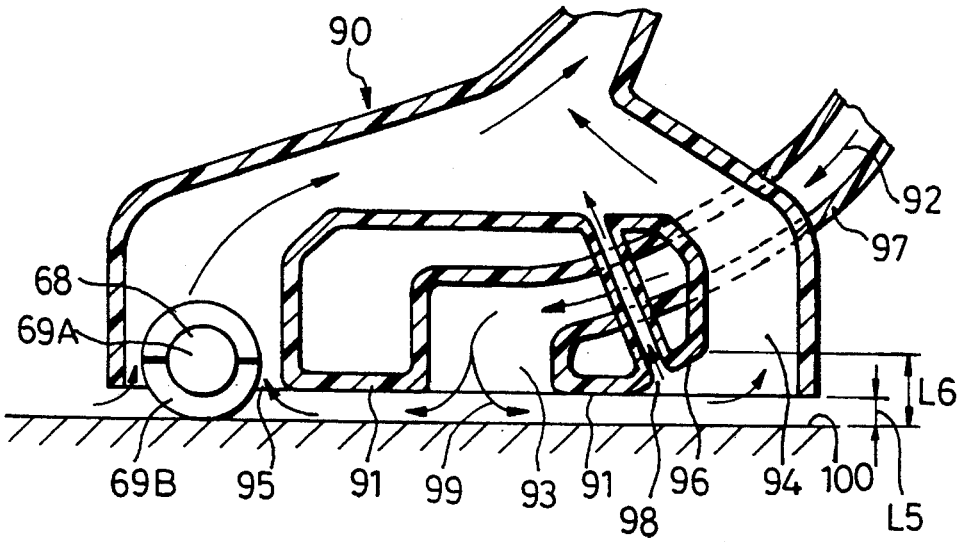
FIG. 10A is a sectional side view showing a floor nozzle unit of an eighth embodiment of the upright vacuum cleaner in accordance with the present invention.
Figure 10B:
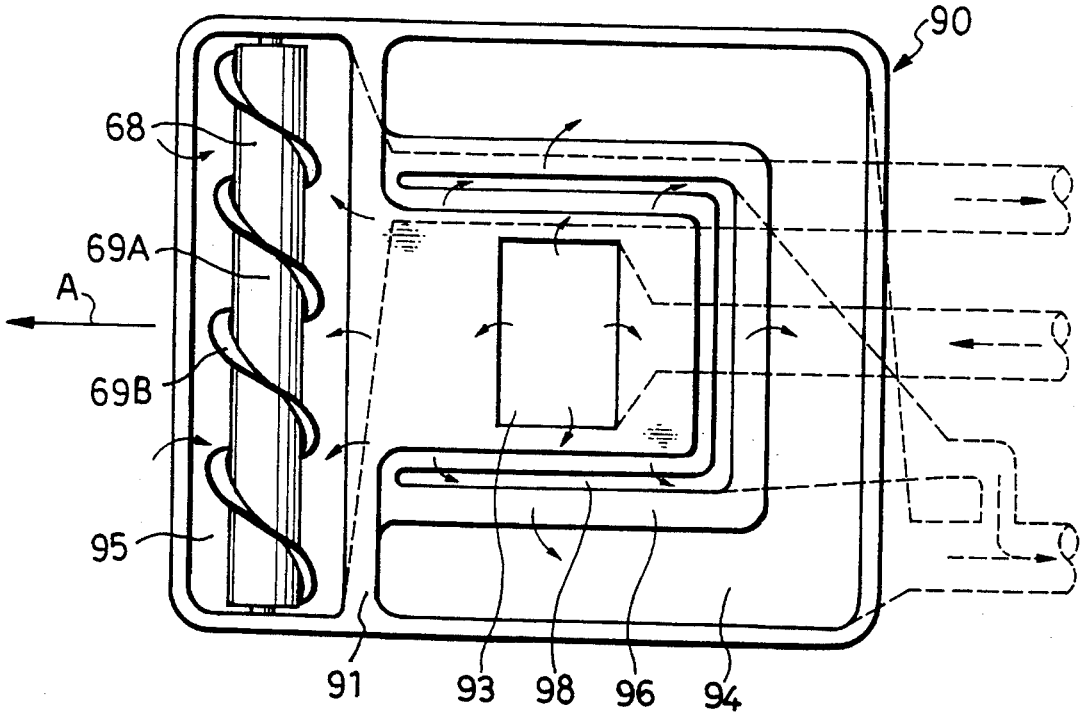
FIG. 10B is a bottom view showing the floor nozzle unit of FIG. 10A.
Figure 11:
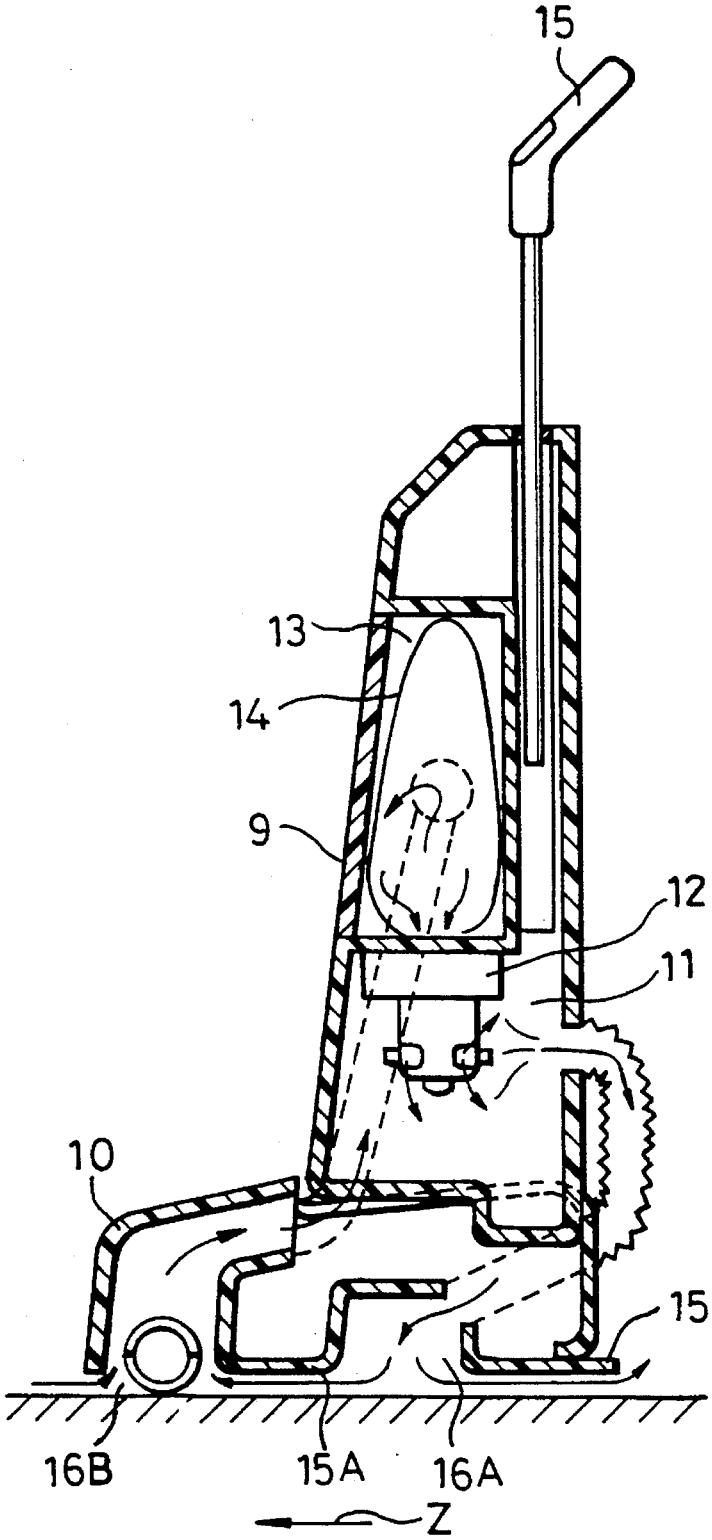
FIG. 11 (Prior Art)
FIG. 11 is the sectional side view showing the upright vacuum cleaner, which directs discharge air flow to the floor so as to elevate from the floor.
Figure 12:
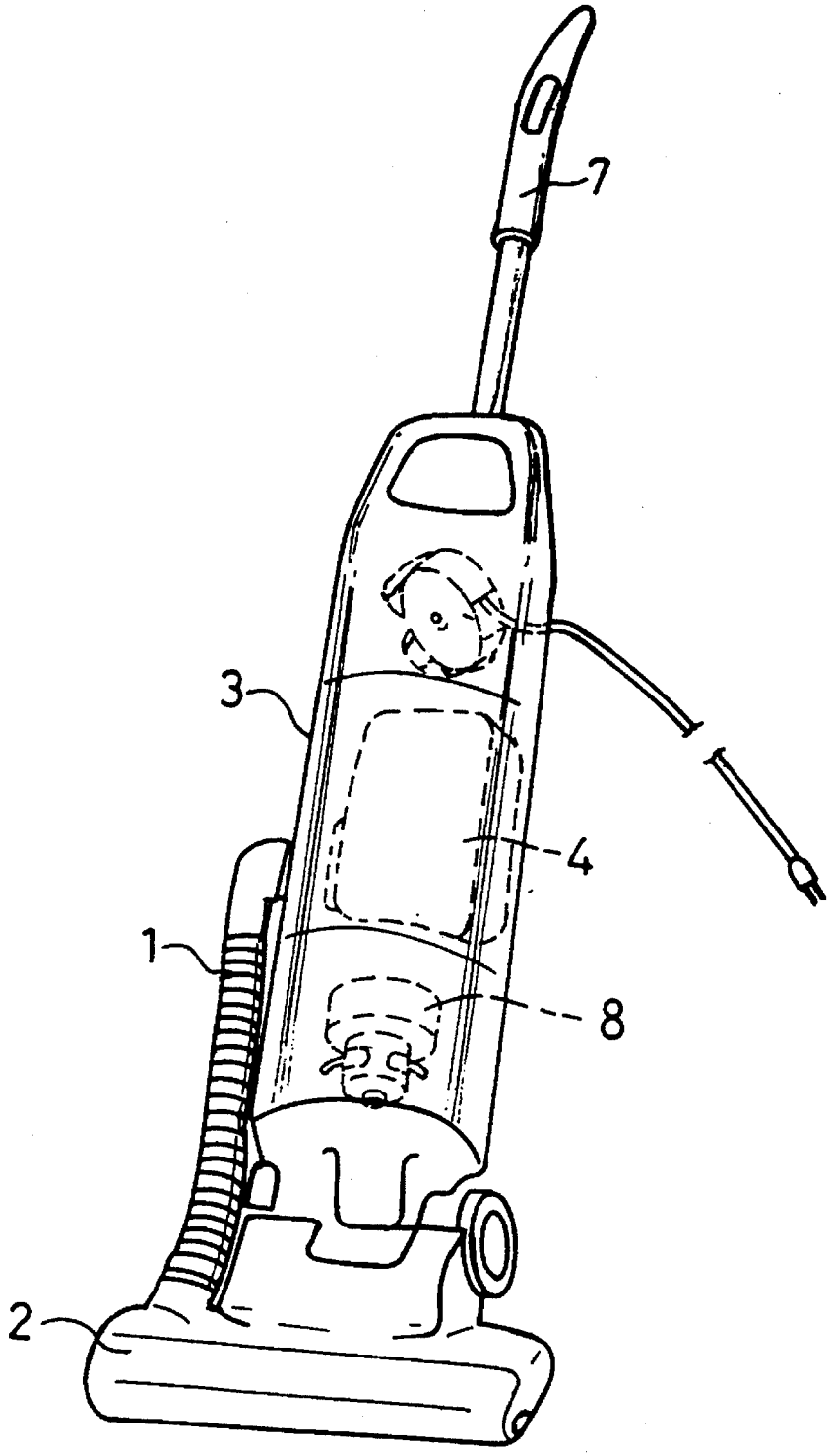
FIG. 12 (Prior Art)
FIG. 12 is the perspective view showing the conventional upright vacuum cleaner.

Hereafter, an upright vacuum cleaner of an eighth embodiment in accordance with the present invention is described with reference to FIGS. 10A and 10B. FIG. 10A is a sectional side view showing a floor nozzle unit 90 of the upright vacuum cleaner of the eighth embodiment. FIG. 10B is a bottom view showing the floor nozzle unit 90 of FIG. 10A. Corresponding parts and components to the first embodiment are shown by the same reference numerals and marks, and the descriptions thereof made in the first embodiment similarly apply. Differences and features of this eighth embodiment from the first embodiment are as follows.

In the eighth embodiment, the floor nozzle unit 90 has a float plate 91 having a flat face which is arranged parallel with the floor 100 to be cleaned. A discharge air outlet port 93 for directing discharge air flow 99 from the motor fan is arranged at a center portion of the float plate 91.

A first suction air inlet port 95 for drawing in air with dust from the floor 100 is arranged at a forward portion (front side) of the flat face of the float plate 91, and has a large and wide opening. A second suction air inlet port 94 is arranged at a right side portion, a left side portion and a back side portion of the outer region in the bottom face of the floor nozzle unit 90. The discharge air outlet port 93 is connected to the motor fan through a discharge air path 97.

The second suction air inlet port 94 has a sloped face 96, which is formed along the inside edge of the second suction air inlet port 94 to continuously connect between the float plate 91 and the second suction air inlet port 94. As shown in FIGS. 10A and 10B, the sloped face 96 has a third suction air inlet port 98, which is connected to the dust collection bag. In FIG. 10A, letters L5 show a distance between the floor 100 and the float plate 91, and letters L6 show a distance between the floor 100 and the outer edge of the sloped face 96. The distances L5 and L6 have the following relation:

$$L5<L6.$$

A rotary brush 68 arranged in the first suction air inlet port 95 is rotated by a motor (not shown) during cleaning. The rotary brush 68 comprises a rotation drum 69A having a helical fin made of an elastic material, such as rubber, or a helical brush for sweeping or brushing the floor 100.

Operation of the above-mentioned eighth embodiment is elucidated hereafter.

When the motor fan rotates, the suction air flow is generated in the first suction air inlet port 95, the second suction air inlet port 94 and the third suction air inlet port 98. At the same time, the discharge air flow 99 is generated in the discharge air outlet port 93. The generated discharge air flow 99 is guided to flow between the float plate 91 and the floor 100, and thereby the upright vacuum cleaner is elevated from the floor 100. The discharge air flow 99 is drawn in by the first suction air inlet port 95, the second suction air inlet port 94 and the third suction air inlet port 98.

In the upright vacuum cleaner of the eighth embodiment since the distance L6 of the outer edge of the sloped face 96 is arranged to be longer than the distance L5 of the plate 91, the velocity of the discharge air flow 99 is reduced in a space under the sloped face 96. A relatively small discharge air flow is drawn in by the third suction air inlet port 98 in the sloped face 96, and thereby the discharge air flow 99 under the sloped face 96 is reduced further. As a result, the discharge air flow 99 can be surely and smoothly drawn in by the second suction air inlet port 94.

The upright vacuum cleaner of the eighth embodiment can be designed to reduce the volume of the suction air flow generated by the motor fan because the necessary suction force for the second suction air inlet port 94 is reduced. The upright vacuum cleaner of the eighth embodiment can be operated to remove dust on the floor 100 with a high degree of efficiency.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. An upright vacuum cleaner comprising:

a main body having a motor fan for generating a suction force, and a dust collection chamber for collecting dust, a floor nozzle unit, which is disposed under said main body, and provided for drawing in dust from a floor to be cleaned into said dust collection chamber by the suction force of said motor fan, a grip handle for moving said upright vacuum cleaner, and a floor-opposing face located on the floor nozzle unit having an outlet port positioned to direct a discharge air flow from said motor fan to said floor to elevate said upright vacuum cleaner from said floor, and at least one inlet port arranged to at least substantially encircle said outlet port of said floor-opposing face to draw air with dust into said dust collection chamber through a suction air path, said at least one inlet port being arranged at an outer portion of said floor-opposing face and having one of a stepped face and a sloped face along an inner edge of said at least one inlet port.

2. An upright vacuum cleaner in accordance with claim 1 wherein said at least one inlet port comprises first and second suction air inlet ports for drawing in dust from a floor to be cleaned, and said first suction air inlet port being arranged at a forward position of said floor-opposing face.

3. An upright vacuum cleaner in accordance with claim 1 wherein said at least one inlet port, which is arranged at an outer portion of said floor-opposing face, is connected to said motor fan by a plurality of suction air paths.

4. An upright vacuum cleaner in accordance with claim 3 wherein said at least one inlet port, which is arranged at an outer portion of said floor-opposing face, includes means for making the suction force constant along said at least one inlet port.

5. An upright vacuum cleaner in accordance with claim 4 wherein the means for making the suction force constant comprise providing the at least one inlet port with one of a sloped face and a curved face.

6. An upright vacuum cleaner in accordance with claim 1 further comprising:

a nozzle located on said floor nozzle unit at a position outside of the position of said at least one inlet port to direct discharge air flow from said motor fan toward said floor to be cleaned, and said nozzle being inclined at a predetermined angle with respect to said floor opposing-face to direct said discharge air flow in an inward direction toward said at least one inlet port.

7. An upright vacuum cleaner in accordance with claim 1 wherein a nozzle is located on the floor nozzle unit outside of said at least one inlet port.

8. An upright vacuum cleaner in accordance with claim 1 wherein the inner edge of the at least one inlet port has a stepped face and a third inlet port is arranged at said stepped face to draw air with dust toward said dust collection chamber.

9. An upright vacuum cleaner in accordance with claim 1 wherein the inner edge of the at least one inlet port has a sloped face and a third inlet port is arranged at said sloped face to draw air with dust toward said dust collection chamber.

* * * * *